US009610788B2

(12) United States Patent
Sakano

(10) Patent No.: US 9,610,788 B2
(45) Date of Patent: Apr. 4, 2017

(54) TAPE CARTRIDGE AND TAPE PRINTING DEVICE

(71) Applicant: Seiko Epson Corporation, Tokyo (JP)

(72) Inventor: Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/122,234

(22) PCT Filed: Mar. 19, 2015

(86) PCT No.: PCT/JP2015/058321

§ 371 (c)(1),
(2) Date: Aug. 29, 2016

(87) PCT Pub. No.: WO2015/146801

PCT Pub. Date: Oct. 1, 2015

(65) Prior Publication Data

US 2016/0368290 A1 Dec. 22, 2016

(30) Foreign Application Priority Data

Mar. 24, 2014 (JP) ..... 2014-060921

(51) Int. Cl.
*B41J 15/04* (2006.01)
*B41J 3/407* (2006.01)
*B41J 15/06* (2006.01)

(52) U.S. Cl.
CPC ..... *B41J 15/044* (2013.01); *B41J 3/4075* (2013.01); *B41J 15/06* (2013.01)

(58) Field of Classification Search
CPC .... B41J 2/175; B41J 2/17503; B41J 2/17563; B41J 2/17566; B41J 2/17593;
(Continued)

(56) References Cited

U.S. PATENT DOCUMENTS 6,190,065 B1 * 2/2001 Brzuskiewicz ..... B41J 15/044 400/613
6,367,995 B1 * 4/2002 Hashimoto ..... B41J 3/4075 400/207

(Continued)

FOREIGN PATENT DOCUMENTS

JP 2005-324555 A 11/2005

OTHER PUBLICATIONS

International Search Report, International Application No. PCT/JP2015/058321, May 19, 2015.

*Primary Examiner* — Kristal Feggins
(74) *Attorney, Agent, or Firm* — ALG Intellectual Property, LLC

(57) ABSTRACT

A tape cartridge to be loaded in an unloadable manner in a tape printing device having an open/close cover to open/close a cartridge loading section where the tape cartridge is loaded. The tape cartridge includes: a tab portion which is provided on a surface of the tape cartridge that faces the open/close cover when loaded in the cartridge loading section, and which is configured to move between a gripping position and a non-gripping position in relation to the surface; and an energizing portion which energizes the tab portion toward the gripping position. The tab portion is pressed by a pressing portion provided on the open/close cover, in a closed state of the open/close cover. The energizing portion is displaced to resist the pressing force of the pressing portion via the tab portion.

10 Claims, 10 Drawing Sheets

(58) Field of Classification Search
CPC . B41J 2/17596; B41J 2/18; B41J 13/00; B41J 15/00; B41J 15/02; B41J 15/044
See application file for complete search history.

(56) References Cited

U.S. PATENT DOCUMENTS

2004/0161278 A1* 8/2004 Harada ..... B41J 15/044
400/621
2008/0165009 A1* 7/2008 Hirota ..... B41J 2/17546
340/572.1

* cited by examiner

TAPE CARTRIDGE AND TAPE PRINTING DEVICE

CROSS-REFERENCE TO RELATED APPLICATIONS

This application is the U.S. National Phase under 35 U.S.C. §371 of International Application No. PCT/JP2015/058321 filed on Mar. 19, 2015, which in turn claims the benefit of Japanese Application No. 2014-060921 filed on Mar. 24, 2014, the disclosures of which are expressly incorporated by reference herein.

TECHNICAL FIELD

The present invention relates to a tape cartridge loaded in an unloadable manner in a cartridge loading section of a tape printing device, and a tape printing device.

BACKGROUND ART

According to the related art, as a tape cartridge of this type, a tape cartridge having a double structure including a tape cassette which accommodates a print tape and a ribbon cassette which accommodates an ink ribbon is known (see JP-2005-324555). In this case, as the ribbon cassette, a plurality of kinds having ink ribbons in different ribbon colors is prepared in order to enable multi-color printing with a tape-like label preparation device. Meanwhile, in the tape-like label preparation device in which the tape cassette and the ribbon cassette are loaded, every time a ribbon cassette with a different ribbon color is loaded, the print tape is rewound and multi-color printing is thus carried out.

The tape cassette is accommodated in an unloadable manner in an inner section corresponding to a cassette cover of the tape-like label preparation device. In the tape cassette, a tape spool with a print tape wound thereon is provided inside a cassette case, and a ribbon cassette housing section where the ribbon cassette is loaded in an unloadable manner is formed.

The ribbon cassette has a ribbon case and an upper wall section extending horizontally from the ribbon case. In the ribbon case, a ribbon spool with an ink ribbon wound thereon and a take-up spool for reeling in the ink ribbon are provided. Meanwhile, two engagement leg portions are provided on the upper wall section. The two engagement leg portions are configured to be engaged with a pair of guide shafts on the side of the device when loaded. Also, a tab piece is formed on the top surface of a cover member of the ribbon case and on the top surface of the upper wall section.

The user holds this pair of tab pieces and loads the ribbon cassette in the tape cassette loaded in the tape-like label preparation device. Of the ribbon cassette loaded in the tape cassette, the ribbon case portion is inserted in the ribbon cassette housing section of the tape cassette, and the two engagement leg portions on the upper wall section are externally fitted with the pair of guide shafts.

SUMMARY

In such a ribbon cassette according to the related art, since the pair of tab pieces provided thereon is protruding from the top surface of the ribbon case (its cover member), the caste cover (open/close cover) needs to be arranged at a high position so as not to interfere with the tab pieces. Therefore, there is a problem of increase in the size of the tape printing device.

Also, since the ribbon cassette is positioned with its two engagement leg portions in relation to the pair of guide shafts across the tape cassette, the upper wall section and the pair of engagement leg portions or the like are required in addition to the ribbon case. Therefore, there is a problem of complication of the structure for positioning the ribbon cassette.

An object of the invention is to provide a tape cartridge and a tape printing device such that the increase in the size of the tape printing device is restrained and that positioning into the cartridge loading section is enabled with a simple structure.

A tape cartridge according to the invention is to be loaded in an unloadable manner in a tape printing device having an open/close cover to open/close a cartridge loading section where the tape cartridge is loaded. The tape cartridge includes: a tab portion which is provided on a surface of the tape cartridge that faces the open/close cover when loaded in the cartridge loading section, and which is configured to move between a gripping position and a non-gripping position in relation to the surface; and an energizing portion which energizes the tab portion toward the gripping position. When the tape cartridge is loaded in the cartridge loading section and the open/close cover is closed, the tab portion is pressed by a pressing portion provided on the open/close cover. When the open/close cover is opened, the energizing portion causes the tab portion to be situated at the gripping position.

According to this configuration, the tab portion is configured to move between the gripping position and the non-gripping position and is pressed by the pressing portion provided on the open/close cover in the state where the open/close cover is closed. Therefore, the open/close cover need not be arranged at a high position so as not to collide with the tab portion moved to the gripping position. Thus, the increase in the size of the tape printing device can be restrained. Also, the energizing portion energizing the tab portion toward the gripping position is displaced in such a way as to resist the pressing force of the pressing portion via the tab portion. Thus, a counterforce generated in the open/close cover elastically presses the tape cartridge via the energizing portion. Therefore, the tape cartridge can be positioned in the cartridge loading section by pressing with a simple structure utilizing the tab portion. Also, in the state where the open/close cover is opened, the tab portion automatically (autonomously) stands up and therefore can be easily gripped.

In this case, it is preferable that the tape cartridge further includes a recessed portion which is provided on a case wall situated on a front side and where the tab portion protrudes and sinks.

According to this configuration, the protruding dimension from the case wall, of the tab portion at the gripping position, can be restrained to be smaller. Therefore, in the tape cartridge as a single unit, obstruction by the tab portion can be restrained.

In this case, it is preferable that the tape cartridge further includes a print tape and a tape core on which the print tape is wound in such a way as to be able to be reeled off, and that the recessed portion is arranged in such a way as to face an inner circumferential part of the tape core via the case wall.

The tape core is formed with a relatively large diameter in order to restrain the persistent curling of the print tape.

According to this configuration, since the recessed portion is arranged utilizing the inner circumferential part of the tape core formed with a relatively large diameter, the tab portion and the recessed portion can be arranged with good space efficiency. Therefore, the increase in the size of the tape cartridge can be restrained.

In this case, it is preferable that the tab portion is mounted in the recessed portion in such a way as to be able to rise and fall between the gripping position where the tab portion protrudes from the recessed portion and the non-gripping position where the tab portion sinks in the recessed portion.

According to this configuration, the structure around the tab portion can be simplified. Also, it is more preferable that the tab portion is mounted in the recessed portion in such away as to be able to swivel. In such a case, it is preferable that the energizing portion is a torsion coil spring provided on a swivel shaft.

Similarly, it is preferable that the tab portion is mounted in the recessed portion in such a way as to be able to advance and retreat between the gripping position where the tab portion protrudes from the recessed portion and the non-gripping position where the tab portion sinks in the recessed portion.

According to this configuration, the structure around the tab portion can be simplified. Also, the tab portion can be provided in a shape that can be easily held or in a posture that can be easily held.

In this case, it is preferable that the tape core is rotatably engaged with an outer circumferential surface of the recessed portion.

According to this configuration, the core shaft of the tape core can also serve as the recessed portion and therefore simplification of the structure and efficient space occupancy can be achieved.

In this case, it is preferable that the energizing portion has a compression coil spring formed by extending a part on the side of the tab portion in a radial direction, that the tape core has a ratchet portion which the part on the side of the tab portion is engaged with and disengaged from, by expansion and contraction of the compression coil spring, and that the part on the side of the tab portion is engaged with the ratchet in the state where the tab portion is moved to the gripping position, and is disengaged from the ratchet in the state where the tab portion is moved to the non-gripping position.

According to this configuration, the compression coil spring of the energizing portion can also serve as a compression coil spring in a rotation stopper mechanism of the tape core. Thus, the increase in the number of components and the number of assembling processes due to the provision of the energizing portion can be restrained.

Also, it is preferable that the tab portion has a rough portion for slip proofing.

According to this configuration, the tab portion can be provided with a less slippery structure and the tab portion can be made more compact accordingly.

Moreover, it is preferable that the tape cartridge further includes a lock mechanism which holds the tab portion at the non-gripping position.

According to this configuration, when loading or unloading the tape cartridge into or from the cartridge loading section, the tab portion is in the state of automatically standing up and therefore can easily function as the site to hold the tape cartridge.

A tape printing device according to the invention includes: a cartridge loading section in which the above tape cartridge is loaded in an unloadable manner; and an open/close cover which opens/closes the cartridge loading section and has a pressing portion for pressing the loaded tape cartridge in a closed state.

According to this configuration, the increase in the size of the device can be restrained without impairing the smoothness of loading and unloading of the tape cartridge. In addition, the tape cartridge can be positioned in the cartridge loading section, with a simple structure.

DESCRIPTION OF EXEMPLARY EMBODIMENTS

Hereinafter, referring to the accompanying drawings, a tape cartridge according to an embodiment of the invention will be described along with a tape printing device in which this tape cartridge is loaded. This tape printing device carries out printing while reeling off a print tape and an ink ribbon from the loaded tape cartridge, and cuts the printed part of the print tape, thus creating a label (tape piece).

[Outline of Tape Printing Device]

Figure 1:
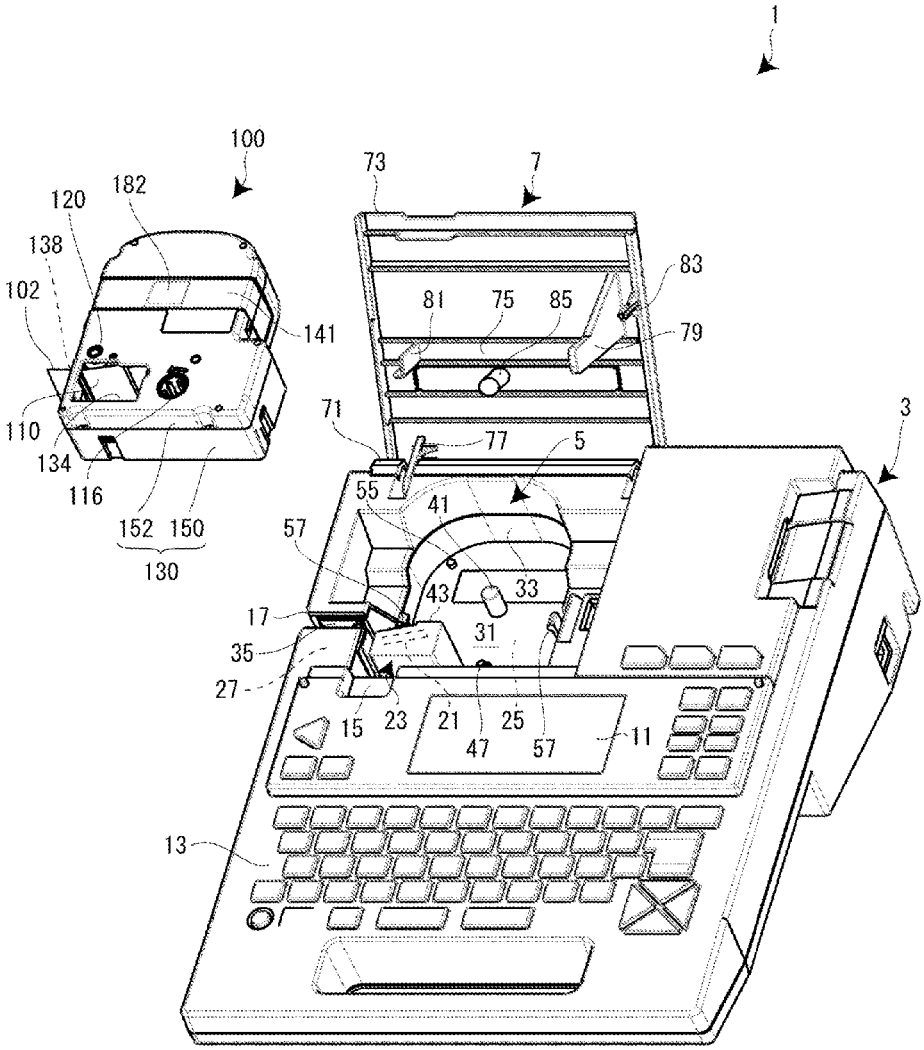
FIG. 1 is an external perspective view showing an open-cover state of a tape printing device according to an embodiment.

FIG. 1 is an external perspective view of a tape printing device and a tape cartridge loaded therein. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On a top surface of the device case 3, the cartridge loading section 5 is provided on the rear side, a display 11 is provided in the center, and a keyboard 13 is provided on the forward side. A dent portion 15 to hook a finger is provided near the open/close cover 7. The open/close cover 7 is opened by having a finger hooked on this dent portion 15 and lifting up the open/close cover 7. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a command on printing is given, the tape feed mechanism section 25 is driven, thus causing the print tape 102 and an ink ribbon 110 to travel in parallel. Moreover, due to the heat applied to the ink ribbon 110 from the print mechanism section 23, the ink of the ink ribbon 110 is thermally transferred to the print tape 102, thus carrying out printing. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 2A, 2B, 5A, and 5B, the tape cartridge 100 includes a tape roll 106 having the print tape 102 wound on a tape core 104, and a ribbon roll 114 having the ink ribbon 110 wound on a reel-off core 112. Also, the tape cartridge 100 includes a take-up core 116 which takes up the ink ribbon 110 after use, and a platen roller 120 (platen) against which the print head 21 abuts via the ink ribbon 110 and the print tape 102 and which feeds the print tape 102 and the ink ribbon 110. Moreover, the tape cartridge 100 has a cartridge case 130 accommodating the tape roll 106, the ribbon roll 114, the take-up core 116 and the platen roller 120. In this way, the tape cartridge 100 in this embodiment has a so-called shell structure in which the outer shell is covered by the cartridge case 130.

Also, the tape cartridge 100 has an insertion opening 134 which is formed in the cartridge case 130 and in which the print head 21 is inserted when the tape cartridge 100 is loaded in the tape printing device 1. Also, the tape cartridge 100 has a tape outlet port 138 which is formed in the cartridge case 130 and through which the print tape 102 is sent out. Although details will be described later, the tape roll 106 is rotatably supported on a cylindrical core shaft 192 protruding to the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a circumferential wall part of the insertion opening 134 and is taken up on the take-up core 116. As the tape cartridge 100, a plurality of types with different thicknesses is prepared according to the tape widths of the print tape 102.

[Details of Tape Printing Device]

Figure 3:
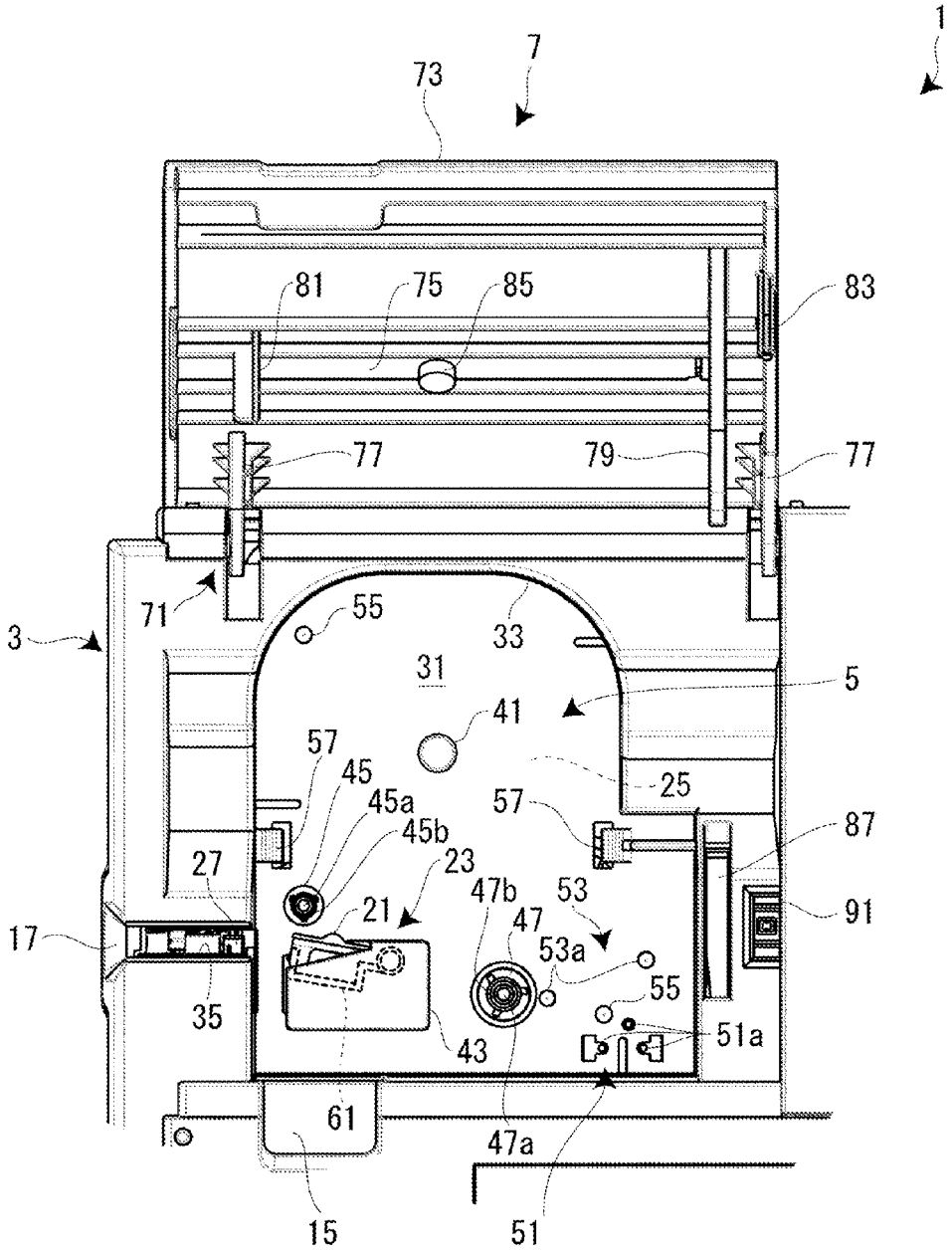
FIG. 3 is a plan view of a cartridge loading section.

As shown in FIG. 1 and FIG. 3, the cartridge loading section 5 is formed in a planar shape complimentary to the planar shape of the tape cartridge 100 and is formed as a dent having a depth corresponding to the tape cartridge 100 with the greatest thickness, of the plurality of types of loadable tape cartridges 100. In this case, a loading base 31 forming a bottom plate part of the cartridge loading section 5, and a side plate part 33 are integrally formed (molded) of a resin or the like. A slit-like tape discharge path 35 is formed between the cartridge loading section 5 and the above tape discharge port 17, and the above tape cutting mechanism section 27 is arranged inside this part.

On the loading base 31 of the cartridge loading section 5, a positioning protrusion 41 with which the core shaft 192 of the tape cartridge 100 is fitted and positioned, and the print head 21 covered by a head cover 43 are provided upright. Also, a platen drive shaft 45 which drives the platen roller 120 to rotate, and a take-up drive shaft 47 which drives the take-up core 116 to rotate are provided upright on the loading base 31. Also, on the loading base 31, a detection section 51 which detects the type (attribute information) of the print tape 102, and a core release section 53 which cancels the rotation stopper of the reel-off core 112 and the take-up core 116 are provided near the take-up drive shaft 47.

Moreover, a pair of small protrusions 55 is provided at diagonal positions on the loading base 31, and in addition, a pair of hook pieces 57 which hooks a middle part of the loaded tape cartridge 100 is provided. Then, in the space on the back of the loading base 31, the above tape feed mechanism section 25 made up of a motor and a gear train (neither being illustrated) or the like for rotating the platen drive shaft 45 and the take-up drive shaft 47 is arranged inside. The tape feed mechanism section 25 performs power branching via the gear train and thus causes the platen drive shaft 45 and the take-up drive shaft 47 to rotate synchronously.

The print mechanism section 23 has the print head 21 made up of a thermal head, and a head support frame 61 which supports the print head 21 and causes the print head 21 to swivel. Also, the print mechanism section 23 has a head release mechanism (not illustrated) which causes the print head 21 to swivel between a print position and a retreat position via the head support frame 61, and the head cover 43 covering the print head 21 (and the head support frame 61).

The head release mechanism is actuated, interlocked with the opening/closing of the above open/close cover 7, and causes the print head 21 to move (swivel) to the print position, interlocked with the closing operation of the open/close cover 7. Also, the head release mechanism causes the print head 21 to move (swivel) to the retreat position, interlocked with the opening operation. The print head 21, having moved to the print position, abuts against the platen roller 120 via the ink ribbon 110 and the print tape 102. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements. The head cover 43 is formed in a substantially rectangular shape, as viewed in a plan view, and is integrally formed (molded) with the above loading base 31 (cartridge loading section 5). Also, the head cover 43 vertically protrudes from the loading base 31, allows the print head 21 to swivel inside the head cover 43, and functions on its outside as a loading guide for the tape cartridge 100.

The detection section 51 is made up of a plurality of microswitches 51*a*, is selectively engaged with a section to be detected 180 of the tape cartridge 100, described later, and detects the type including tape width, tape color, material and the like of the print tape 102. Then, on the basis of the result of the detection, the driving of the print head 21 and the tape feed mechanism section 25 is controlled. The core release section 53 is made up of two cancellation pins 53*a* for the reel-off core 112 and the take-up core 116. As will be described in detail later, rotation stopper hooks 206 (see FIG. 6) to be hooked on the reel-off core 112 and the take-up core 116, respectively, are provided in the cartridge case 130. As the tape cartridge 100 is loaded, these rotation stopper hooks 206 are engaged with the cancellation pins 53*a*, cancelling the rotation stopper of the reel-off core 112 and the take-up core 116.

The platen drive shaft 45 has a fixed shaft 45*a* extending to be long enough to be inserted through the platen roller 120, and a spline-shaped movable shaft 45*b* rotatably axially supported at a proximal part of the fixed shaft 45*a*. The rotational power of the tape feed mechanism section 25 is transmitted to this movable shaft 45*b* and further transmitted from the movable shaft 45*b* to the platen roller 120. Similarly, the take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Moreover, the take-up core 116 is engaged with the take-up drive shaft 47. Then, as the open/close cover 7 is closed, the print head 21 swivels and abuts against the platen roller 120 via the print tape 102 and the ink ribbon 110. Thus, the tape printing device 1 enters into a print standby state.

Figure 4:
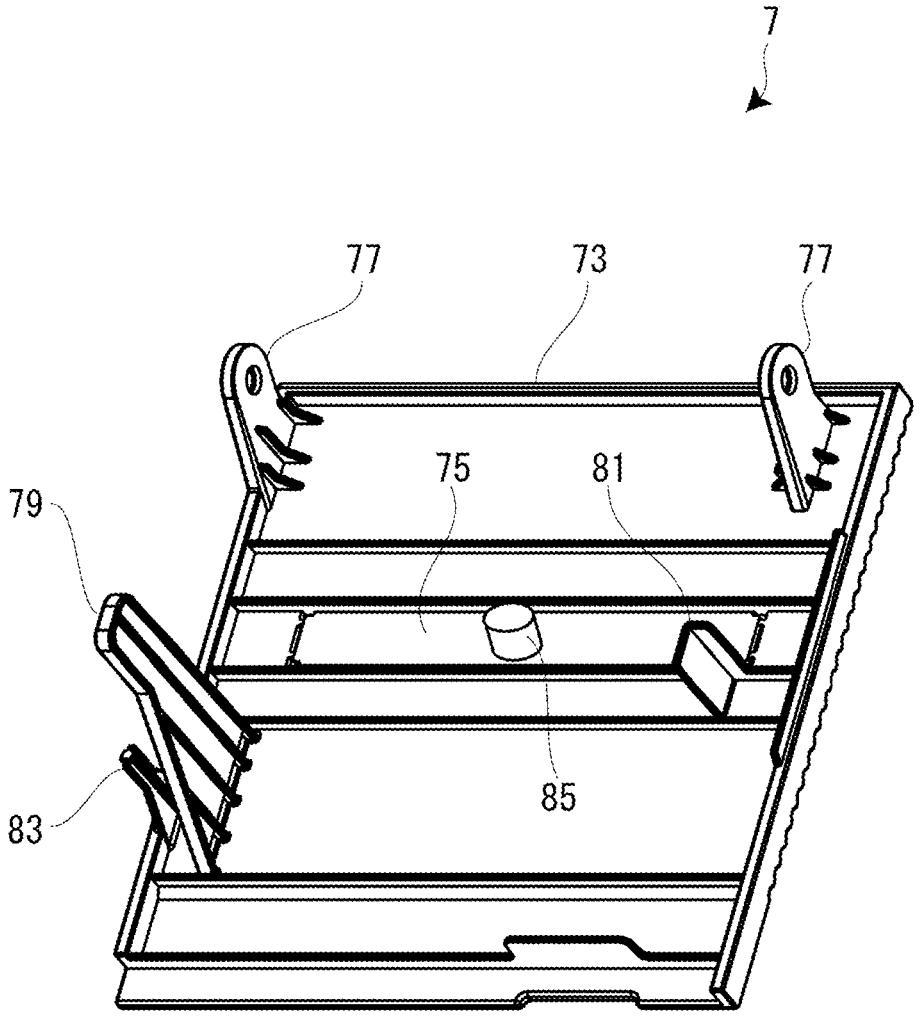
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73 formed in a rectangular shape as viewed in a plan view, a view window 75 provided at the center of the open/close cover main body 73, and a pair of shaft support pieces 77 protruding on the back of the open/close cover main body 73 and rotatably axially supported on the hinge portion 71. Also, the open/close cover 7 has an actuation lever 79 which protrudes on the back of the open/close cover main body 73 and causes the print head 21 to swivel, and a push-in protrusion 81 which protrudes on the back of the open/close cover main body 73 and pushes in the tape cartridge 100. Moreover, the open/close cover 7 has a press protrusion 83 which protrudes on the back of the open/close cover main body 73 and actuates (turns ON) a built-in cover closing detection switch (not illustrated).

Also, the open/close cover 7 has a pressing portion 85 which protrudes on the back of the view window 75 and presses a tab portion 182 of the tape cartridge 100, described later. As will be described in detail later, when the open/close cover 7 is closed, this pressing portion 85 elastically presses the tape cartridge 100 to the cartridge loading section 5 (loading base 31) via the tab portion 182.

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Then, the view window 75 and the above pressing portion 85 are integrally formed (molded) of a resin. Similarly, the pair of shaft support pieces 77, the actuation lever 79, the push-in protrusion 81, the press protrusion 83, and the open/close cover main body 73 are integrally formed (molded) of a resin.

The actuation lever 79 protrudes from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21 to swivel toward the platen roller 120. Similarly, with the closing of the open/close cover 7, the press protrusion 83 is inserted in a rectangular opening 91 next to the slit opening 87 and actuates (for example, turns "ON") the cover closing detection switch. The push-in protrusion 81 corresponds to a position near the platen roller 120 of the tape cartridge 100. With the closing of the open/close cover 7, the push-in protrusion 81 pushes in the tape cartridge 100 so that the tape cartridge 100 sits on the loading base 31 of the cartridge loading section 5.

[Details of Tape Cartridge]

Next, the tape cartridge 100 will be described in detail, referring to FIGS. 2A, 2B, 5A, 5B, and 6. In the description of the tape cartridge 100, taking FIGS. 2A and 2B as an example, the forward side in the loading direction, which is the top front side of the tape cartridge 100, is referred to as the "front side", and the rear side in the loading direction, which is the opposite side, is referred to as the "back side". Also, taking FIGS. 2A and 2B as an example, the lateral side on the left of the tape cartridge 100 is referred to as the "left lateral side", the lateral side on the right as the "right lateral side", the arcuate side on the top as the "distal side", and the bottom side as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, and the tape outlet port 138 formed on the left lateral side, near the platen roller 120. Moreover, the tape cartridge 100 has an identification seal 141 (see FIGS. 2A and 2B) bonded over two portions on the front side, the left lateral side and the right lateral side of the part where the tape roll 106 is accommodated. The identification seal 141 shows the tape width, tape color, material and the like of the print tape 102 accommodated in the cartridge case 130.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a resin that is transparent enough to make the accommodated print tape 102 visible, and the lower case 150 is formed by a molded member of an opaque resin. As described above, a plurality of types with different thicknesses is prepared as the tape cartridge 100, and the difference in thickness is adjusted by the lower case 150 while the upper case 152 is used as a common component.

The upper case 152 is integrally formed (molded) by a top wall portion 156 forming the front side of the cartridge case 130, and an upper circumferential wall portion 158 suspended on a circumferential edge part of the top wall portion 156. Meanwhile, the lower case 150 is integrally formed (molded) by a bottom wall portion 160 forming the back side of the cartridge case 130, a lower circumferential wall 162 provided upright on a circumferential edge part of the bottom wall portion 160, and an opening circumferential wall portion 164 provided upright on the bottom wall portion 160 so as to define the above insertion opening 134.

Figures 5A, 5B:
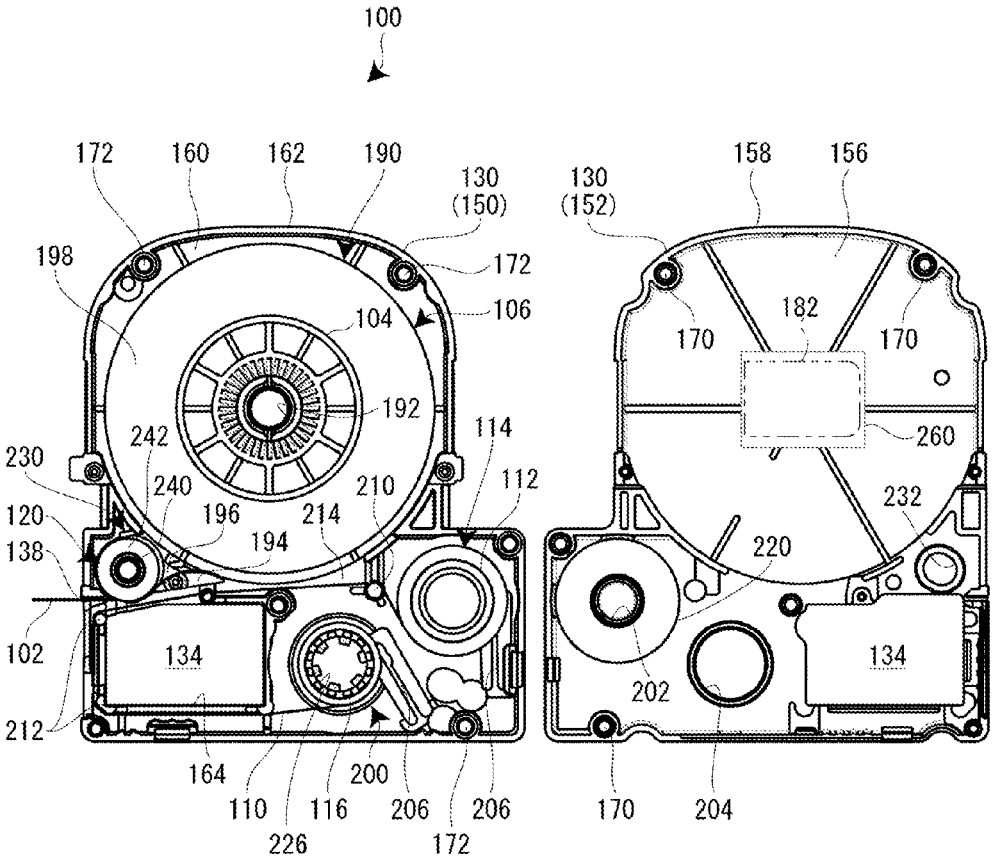
FIG. 5A is a plan view of a tape cartridge in the state where an upper case is unloaded.
FIG. 5B is a back view of the upper case.

A plurality of joint pins 170 is provided at a proper interval on a lower end surface of the upper circumferential wall portion 158 of the upper case 152, whereas a plurality of joint holes 172 corresponding to the plurality of joint pins 170 is provided in the lower circumferential wall 162 of the lower case 150 (see FIGS. 5A and 5B). After components such as the tape roll 106 and the ribbon roll 114 are arranged in the lower case 150, the upper case 152 is joined thereto in such away that the plurality of joint pins 170 is press-fitted in the plurality of joint holes 172, thus assembling the tape cartridge 100. Each joint hole 172 is a through-hole in consideration of easiness of molding.

Figure 2A:
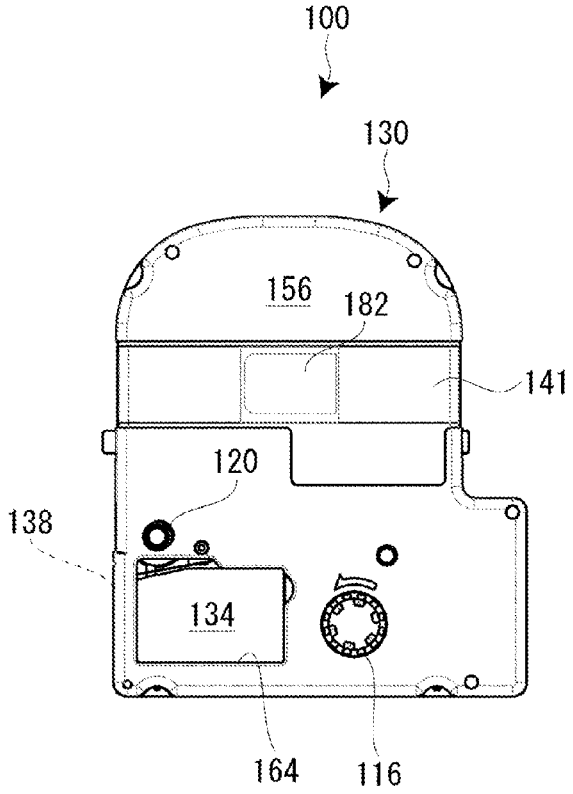
FIG. 2A is a plan view and FIG. 2B is a side view of a tape cartridge according to an embodiment.
Figure 2B:
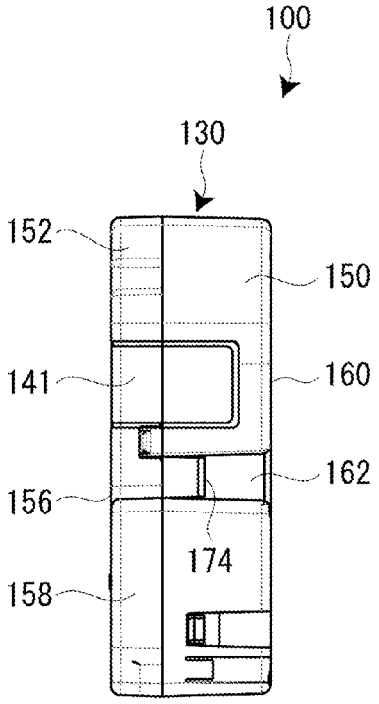
Figure 6:
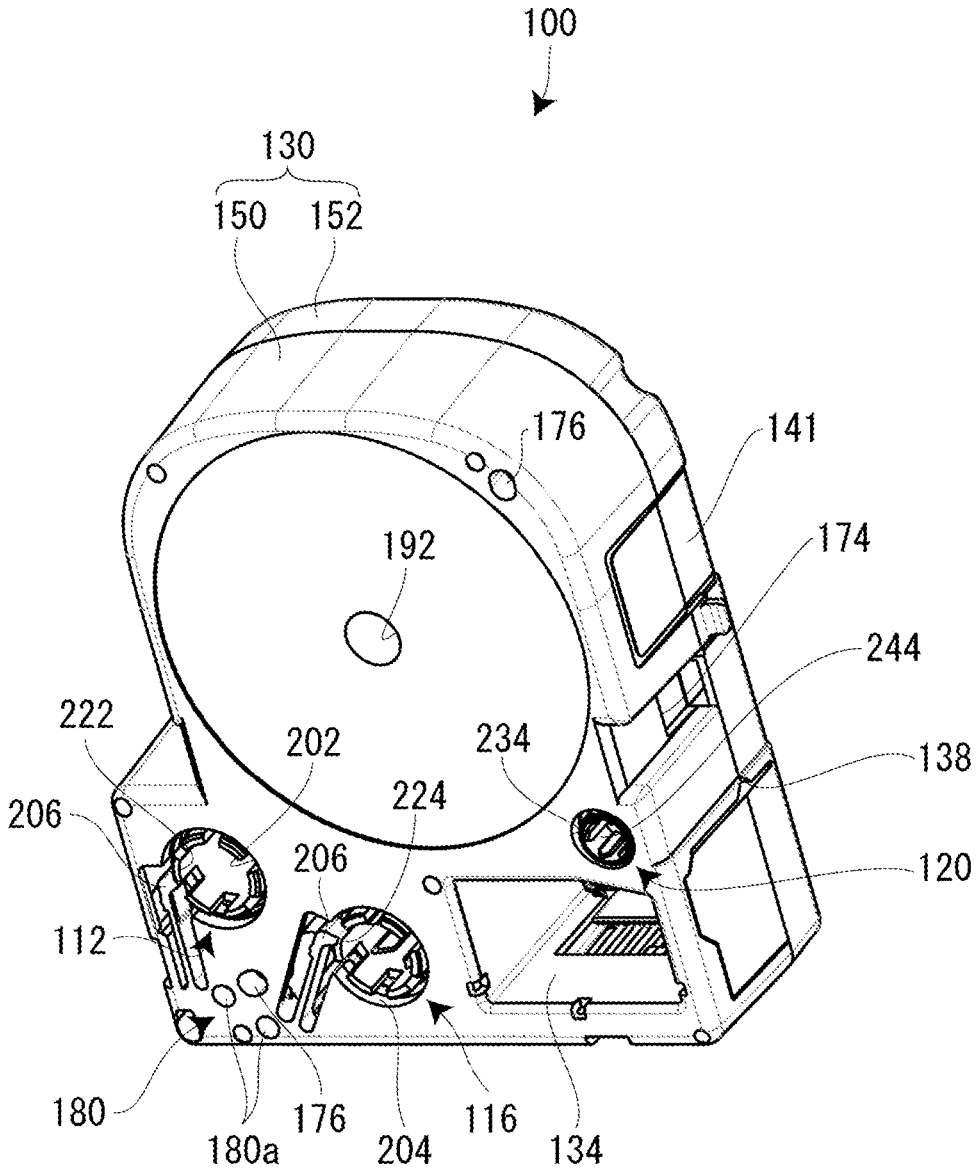
FIG. 6 is a perspective view of a tape cartridge, as viewed from the back side.
Figure 7:
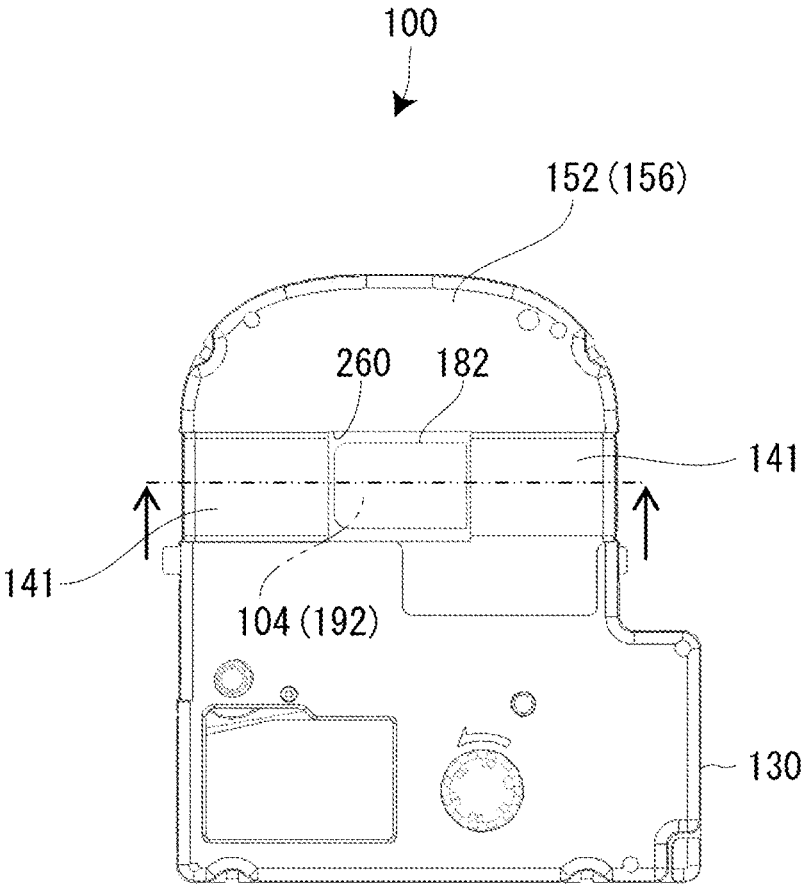
FIG. 7 is a plan view of a tape cartridge according to a first embodiment.

Meanwhile, a pair of hook receiving portions 174 to be hooked on the above pair of hook pieces 57 is provided on the left lateral side and the right lateral side of the lower case 150 (see FIGS. 2A and 2B and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 are fitted with a certain margin are provided on the back side of the lower case 150 (see FIG. 6). As the pair of small protrusions 55 on the side of the cartridge loading section 5 is fitted in the fitting small holes 176, the tape cartridge 100 is easily positioned on the loading base 31.

Moreover, on the back side of the lower case 150, the section to be detected 180 corresponding to the above detection section 51 is provided at a position in the left corner on the proximal side (right corner as viewed from the front side) (see FIG. 6). The section to be detected 180 is formed by a section corresponding to the plurality of micro-switches 51*a* of the detection section 51, and a plurality of bit patterns is acquired according to the presence/absence of receiving holes 180*a* provided in this section. That is, the bit patterns correspond to the type of the above printed tape 102.

Meanwhile, the tab portion 182 to grip the tape cartridge 100 is provided at a position between the identification seals 141 in the two positions, on the front side of the tape cartridge 100 (see FIGS. 2A and 2B). That is, on the front side of the upper case 152, the tab portion 182 is provided directly above the above core shaft 192 (tape core 104). As will be described in detail later, the tab portion 182 functions as the part to grip the tape cartridge 100 when loading and unloading the tape cartridge 100 into and from the cartridge loading section 5. Also, the tab portion 182 functions as the part to receive the pressing portion 85 of the open/close cover 7, which presses the tape cartridge 100 when the open/close cover 7 is closed.

As shown in FIGS. 5A and 5B, a broad tape accommodation area 190 in which the tape roll 106 is accommodated is formed in a space on the upper side (distal side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two circular films 198 bonded to both end surfaces of the print tape 102 in a roll shape. The two circular films 198 prevent the print tape 102 wound on the tape core 104 from unwinding. Also, a reverse rotation stopper mechanism is incorporated in the tape core 104, though not illustrated (whereas in a second embodiment, described later, a similar reverse rotation stopper mechanism is illustrated). When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening peripheral wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening circumferential wall portion 164 (the plurality of second ribbon guides 212) from the platen roller 120, and is taken up on the take-up core 116.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part (see FIG. 5B for each of these parts).

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged from the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic (oval) opening formed in the lower case 150, and an upper bearing portion 232 (see FIG. 5B) in the form of an elliptic (oval) opening formed in the upper case 152 are provided. Then, on the upper bearing portion 232 and the lower bearing portion 234, the platen roller 120 is supported in a rotatable and slightly movable (laterally movable) manner. That is, the platen roller 120 supported on the elliptic upper bearing portion 232 and lower bearing portion 234 is configured to be movable (finely movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, which is drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the print position, abuts against this rubber roller 242 with the print tape 102 and the ink ribbon 110 nipped between them. Also, a spline groove 244 is formed on the inner circumferential surface of the roller base 240 and spline-engaged with the above platen drive shaft 45. Thus, the rotational force of the platen drive shaft 45 is transmitted to the platen roller 120, and the print tape 102 (and the ink ribbon 110) is fed for printing.

[Tab Portion and Pressing Portion (First Embodiment)]

Next, referring to FIG. 7 and FIGS. 8A-8C, the structure of the tab portion 182 of the tape cartridge 100 according to a first embodiment will be described in detail along with the structure of the pressing portion 85 of the open/close cover 7. As described above, the tab portion 182 is provided on the front side of the upper case 152, and the pressing portion 85 is provided in such a way as to protrude on the back side of the open/close cover 7, corresponding to the tab portion 182.

As shown in FIG. 7 and FIGS. 8A-8C, on the tape cartridge 100, the tab portion 182 is provided between the identification seals 141, that is, directly above the tape core 104 (core shaft 192). Specifically, on the top wall portion 156 (case wall) of the upper case 152, a recessed portion 260 which is rectangular as viewed in a plan view is provided directly above the tape core 104 (core shaft 192), and the tab portion 182 is provided in such a way as to be accommodated inside the recessed portion 260.

The tape core 104 has a reel portion 270 with the print tape 102 wound thereon, and a roll contact portion 272 provided to the inner side of the reel portion 270. The roll contact portion 272 is provided in a middle part between the top and bottom of the reel portion 270 and rotatably supported at an upper part of the core shaft 192 extending from the lower case 150. The reel portion 270 is formed with a relatively large diameter in order to restrain the persistent curling of the print tape 102. Therefore, a circular in-core space 274 is formed at a part surrounded by the inner circumferential surface of the reel portion 270 and the top surface of the roll contact portion 272, and the above recessed portion 260 is formed as a dent in this in-core space 274.

The recessed portion 260 is formed integrally with the upper case 152 (top wall portion 156), in the form of being contained in the in-core space 274. Also, the recessed portion 260 is formed in a rectangular shape corresponding to the tab portion 182 formed in a rectangular shape and has a sufficient depth to allow the tab portion 182 to sink therein. However, the tab portion 182 need not necessarily be rectangular.

The tab portion 182 is formed in the shape of a rectangular plate having a shaft hole 280 at a proximal part and is rotatably supported in the recessed portion 260 via a swivel support shaft 282 inserted through the shaft hole 280. In this case, the tab portion 182 is supported in the recessed portion 260 in such a way as to be able to swivel between a gripping position and a non-gripping position about the swivel support shaft 282, that is, to be able to rise and fall. Also, the swivel support shaft 282 is provided with an energizing portion 284 formed by a torsion coil spring, and the energizing portion 284 energizes the tab portion 182 toward the gripping position. The gripping position is a position where the energizing portion 284 is in a free state (no energizing force), and the tab portion 182 is tilted at around 45 degrees to the top wall portion 156.

Figure 8A:
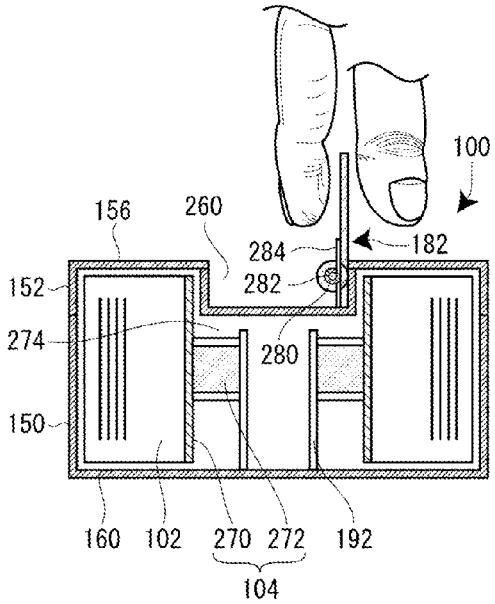
FIG. 8A is an enlarged cross-sectional view showing a state where a tab portion of the tape cartridge according to the first embodiment is gripped.
Figure 8B:
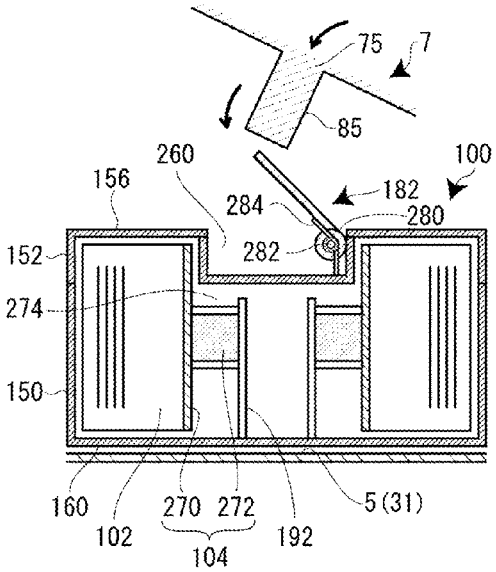
FIG. 8B is an enlarged cross-sectional view showing a non-pressed state of the tab portion.
Figure 8C:
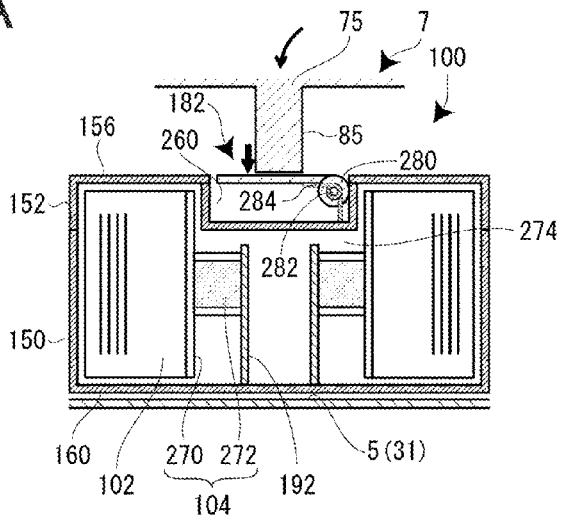
FIG. 8C is an enlarged cross-sectional view showing a pressed state of the tab portion.
Figure 9:
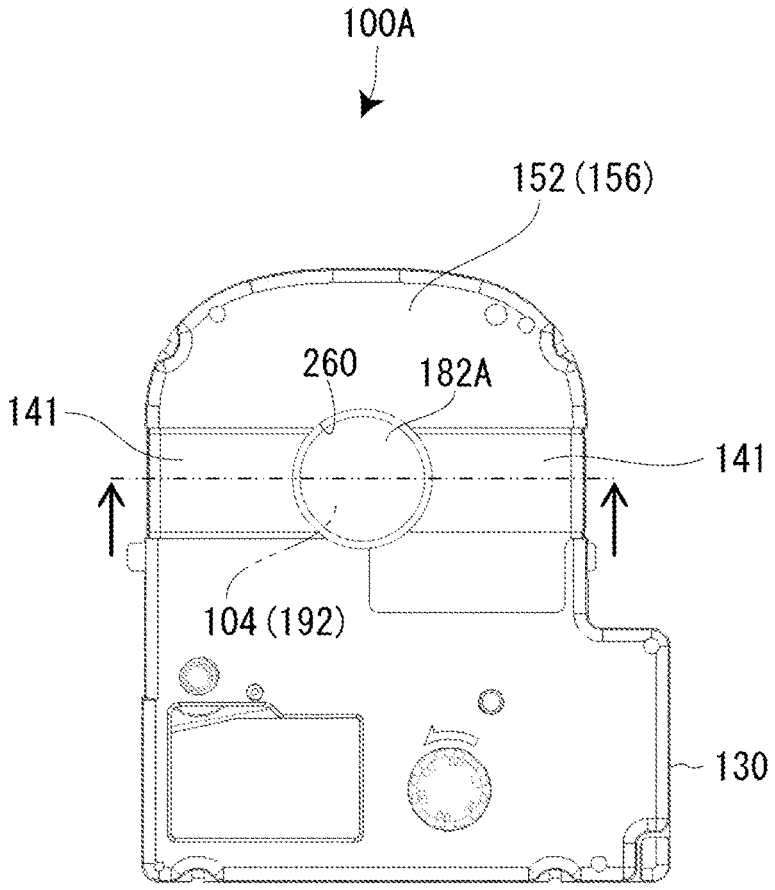
FIG. 9 is a plan view of a tape cartridge according to a second embodiment.

Meanwhile, as shown in FIGS. 8A-8C, the pressing portion 85 pressing the tab portion 182 is arranged at a position corresponding to the tab portion 182 of the open/close cover 7 when closed. Specifically, the pressing portion 85 is provided in such a way as to protrude to the center on the back side of the view window 75 of the open/close cover 7. The pressing portion 85 is formed into a circular cross section or a rectangular cross section, for example, and with the closing of the open/close cover 7, presses the tab portion 182 of the tape cartridge 100 loaded in the cartridge loading section 5.

FIG. 8A shows the state where the tab portion 182 is gripped when loading or unloading the tape cartridge 100. As the tab portion 182 made to swivel to the gripping position (protrude from the recessed portion 260) by the energizing portion 284 is gripped, the tab portion 182 takes a posture perpendicular to the tape cartridge 100 (top wall portion 156). The user grips the tape cartridge 100 via the tab portion 182, and in this state, loads and unloads (pulls out) the tape cartridge 100 in and from the cartridge loading section 5.

FIG. 8B shows the state where the tape cartridge 100 is loaded in the cartridge loading section 5 (the state where the open/close cover 7 is half-closed). The tab portion 182 is energized toward the gripping position by the energizing portion 284, and the tab portion 182 is tilted at around 45 degrees to the top wall portion 156. That is, the energizing portion 284 is displaced into the free state and the tab portion 182 is in the posture of protruding and standing up from the recessed portion 260.

FIG. 8C shows the state where the open/close cover 7 is closed. As the open/close cover 7 is closed, the pressing portion 85 of the open/close cover 7 presses the tab portion 182, against the energizing portion 284. Thus, the tab portion 182 swivels from the gripping position to the non-gripping position and takes a fall-in posture in such a way as to sink in the recessed portion 260. In this state, the energizing force of the energizing portion 284 acts on the pressing portion 85 (open/close cover 7) via the tab portion 182. Meanwhile, the open/close cover 7 (pressing portion 85) causes a counterforce to this energizing force to act on the tape cartridge 100 via the tab portion 182 and the energizing portion 284. Therefore, the tape cartridge 100 is elastically pressed by the closed open/close cover 7.

As described above, according to the first embodiment, the tab portion 182 is configured in such a way as to be able to swivel between the gripping position and the non-gripping position so as to protrude from and sink in the recessed portion 260, in the state of being energized by the energizing portion 284. Therefore, since the tab portion 182 is in the state of automatically rising up when loading or unloading the tape cartridge 100 in or from the cartridge loading section 5, the tab portion 182 can be easily made to function as the part to grip the tape cartridge 100. Thus, a portion for inserting a finger need not be provided in the cartridge loading section 5, and the tape printing device 1 can be formed compactly. Also, as the open/close cover 7 is closed, the tab portion 182 swivels to the non-gripping position and therefore does not obstruct the closing of the open/close cover 7. Also in this respect, the tape printing device 1 can be formed compactly.

Meanwhile, the tab portion 182 and the energizing portion 284 can be made to function in such a way as to elastically press the tape cartridge 100 when the open/close cover 7 is closed. Thus, not only the tape cartridge 100 can be prevented from floating up but also the tape cartridge 100 can be positioned in the cartridge loading section 5. Therefore, misalignment of the tape cartridge 100 is restrained with the pressing force from the print head 21 or the like, thus enabling enhanced print quality.

While the tab portion 182 in the first embodiment swivels about the swivel support shaft 282 extending in a forward-rear direction, the tab portion 182 may be configured to swivel about the swivel support shaft 282 extending in a left-right direction. Also, it is preferable a slip-proof measure such as a rough portion is provided on the surface of the tab portion 182. In this case, since the tab portion 182 has a structure that is easy to grip, the tab portion 182 can be decreased in size. Also, as a modification example, though not illustrated, a lock mechanism which locks the tab portion 182 in the state of being inside the recessed portion 260 against the spring force of the energizing portion 284 can be added. If the lock mechanism is added, when storing a plurality of tape cartridges 100, it is easy to stack (store) the tape cartridges on each other. Also, it goes without saying that the addition of the lock mechanism can be applied to other examples described below.

[Tab Portion and Pressing Portion (Second Embodiment)]

Next, referring to FIG. 9 and FIGS. 10A-10C, the structure of a tab portion 182A of a tape cartridge 100A according to a second embodiment will be described in detail along with the structure of the pressing portion 85 of the open/close cover 7. Also, in the second embodiment, different parts from those in the first embodiment will be mainly described.

As shown in FIG. 9 and FIGS. 10A-10C, a cylindrical upper core shaft 310 is suspended on the top wall portion 156 of the upper case 152, and a cylindrical lower core shaft 312 is provided upright on the bottom wall portion 160 of the lower case 150. The roll contact portion 272 of the tape core 104 comes in an up-down gap between the upper core shaft 310 and the lower core shaft 312. The tape core 104 is rotatably supported on the upper core shaft 310 and the lower core shaft 312 situated coaxially in the part of the reel portion 270.

On the bottom surface of the roll contact portion 272, a ratchet portion 314 formed by a plurality of grooves extending radially is provided (see FIG. 5A). Meanwhile, the recessed portion 260 is formed in an inner circumferential part of the upper core shaft 310, and the tab portion 182A advancing and retreating between the gripping position and the non-gripping position is accommodated in this recessed portion 260. Also, in an inner circumferential part of the lower core shaft 312, an energizing portion 284A which energizes the tab portion 182A toward the gripping position and is formed by a compression coil spring is accommodated.

The energizing portion 284A formed by a compression coil spring has its wire end part 316 extending in a radial direction and is engaged with and disengaged from the above ratchet portion 314 from below. That is, in the state where the tab portion 182A is made to move (advance) to the gripping position by the energizing portion 284A, the wire end part 316 is engaged with the ratchet portion 314, and in the state where the tab portion 182A is made to move (retreat) to the non-gripping position against the energizing portion 284A, the wire end part 316 is disengaged from the ratchet portion 314. That is, a reverse rotation stopper mechanism of the tape core 104 (tape roll 106) is formed by the ratchet portion 314 of the tape core 104, and the energizing portion 284A energizing the tab portion 182A.

As described above, the bottomless recessed portion 260 is formed in the inner circumferential part of the upper core shaft 310. Also, in the recessed portion 260, the tab portion 182A is provided in such a way as to be able to advance and retreat between the gripping position and the non-gripping position. The tab portion 182A is integrally formed by a tab portion main body 320 with its upper half part protruding from and sinking in the recessed portion 260, a portion to be guided 322 guided in such a way as to be able to advance and retreat on the inner circumferential surface of the upper core shaft 310, and an abutting shaft portion 324 continuing to the bottom side of the tab portion main body 320 and abutting against the energizing portion 284A.

The portion to be guided 322 is formed with a greater diameter than the tab portion main body 320. The abutting shaft portion 324 is formed with a smaller diameter than the tab portion main body 320. The tab portion 182A is formed in the shape of a stepped column as a whole. An annular recessed portion 326 is formed on the lateral side of the upper half part of the tab portion main body 320, and this annular recessed portion 326 functions as a slip-proofing measure at the time of gripping. The portion to be guided 322 is in slide-contact with the inner circumferential surface of the upper core shaft 310 in a slidable manner (to be able to advance and retreat) in an up-down direction. Also, the abutting shaft portion 324 abuts against the energizing portion 284A in such a way as to be loosely inserted in the inner circumferential part of the roll contact portion 272 of the tape core 104. Instead of the annular recessed portion 326, a rough portion such as knurling may be provided.

The tab portion 182A, having moved to the gripping position, is energized by the energizing portion 284A, and its portion to be guided 322 is abutting an opening edge part of the recessed portion 260 from below. In the tab portion 182A in this state, the upper half part of the tab portion main body 320 protrudes from the recessed portion 260, and the annular recessed portion 326 of the tab portion main body 320 is exposed. Also, the tab portion 182A, having moved to the non-gripping position, is pushed in by the pressing portion 85 of the open/close cover 7, and the tab portion main body 320 sinks inside the recessed portion 260.

Figure 10A:
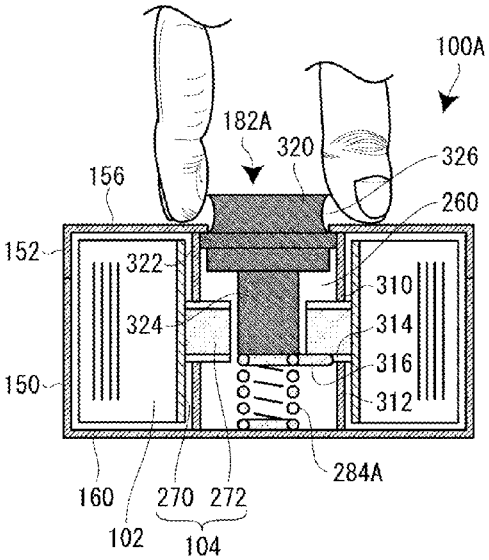
FIG. 10A is an enlarged cross-sectional view showing a state where a tab portion of the tape cartridge according to the second embodiment is gripped.

FIG. 10A shows the state where the tab portion 182A is gripped when loading or unloading the tape cartridge 100A. The tab portion 182A made to move (advance) to the gripping position by the energizing portion 284A, and the annular recessed portion 326 of the tab portion main body 320 is protruding from the recessed portion 260. The user grips the tape cartridge 100A via the tab portion 182A, and in this state, loads and unloads (pulls out) the tape cartridge 100A in and from the cartridge loading section 5.

Also, in this state, the wire end part 316 of the energizing portion 284A is engaged with the ratchet portion 314. Thus, when carrying the tape cartridge 100A and when loading or unloading the tape cartridge 100A, the reverse rotation (in practice, forward and reverse rotation) of the tape roll 106 is prevented.

Figure 10B:
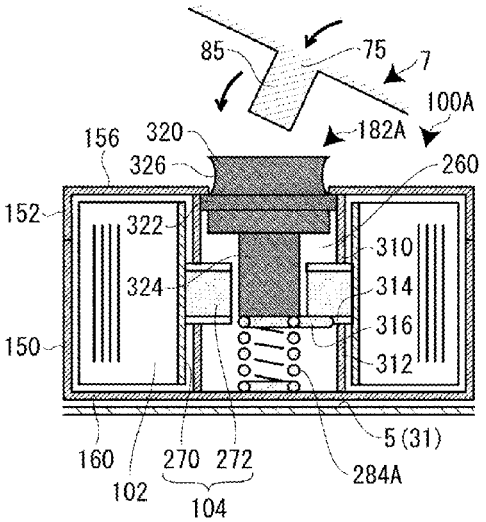
FIG. 10B is an enlarged cross-sectional view showing a non-pressed state of the tab portion.

FIG. 10B shows the state where the tape cartridge 100A is loaded in the cartridge loading section 5. The tab portion 182A and the energizing portion 284A in this case are in the same state as in FIG. 10A.

Figure 10C:
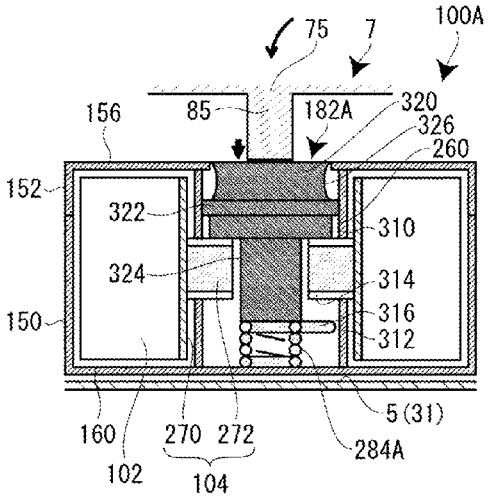
FIG. 10C is an enlarged cross-sectional view showing a pressed state of the tab portion.

FIG. 10C shows the state where the open/close cover 7 is closed. As the open/close cover 7 is closed, the pressing portion 85 of the open/close cover 7 presses the tab portion 182A, against the energizing portion 284A. Thus, the tab portion 182A moves (retreats) from the gripping position to the non-gripping position and sinks in the recessed portion 260. In this state, the energizing force of the energizing portion 284A acts on the pressing portion 85 (open/close cover 7) via the tab portion 182A. Meanwhile, the open/close cover 7 (pressing portion 85) causes a counterforce to this energizing force to act on the tape cartridge 100A via the tab portion 182A and the energizing portion 284A. Therefore, the tape cartridge 100A is elastically pressed by the closed open/close cover 7.

Also, as the energizing portion 284A is pushed and compressed by the tab portion 182A, the wire end part 316 of the energizing portion 284A is disengaged from the ratchet portion 314. Thus, the reverse rotation (in practice, forward and reverse rotation) of the tape roll 106 is released, thus enabling the tape printing device 1 to feed the print tape 102.

As described above, according to the second embodiment, as in the first embodiment, the tab portion 182A can be made to function as the part to grip the tape cartridge 100A, and the tab portion 182A does not obstruct the closing of the open/close cover 7. Therefore, the tape printing device 1 can be formed compactly. Also, the tab portion 182A and the energizing portion 284A can be made to function so as to elastically press the tape cartridge 100A when the open/close cover 7 is closed. Thus, not only the tape cartridge 100A can be prevented from floating up but also the tape cartridge 100A can be positioned in the cartridge loading section 5.

Moreover, the energizing portion 284A in the second embodiment also serves as the spring of the reverse rotation stopper mechanism. Therefore, the increase in the number of components and the number of assembling processes due to the provision of the energizing portion 284A can be restrained.

Also, the energizing portion 284A in the second embodiment may simply be a coil or leaf spring which energizes the tab portion 182A, without serving as the spring of the reverse rotation stopper mechanism.

The invention claimed is:

1. A tape cartridge to be loaded in an unloadable manner in a tape printing device having an open/close cover to open/close a cartridge loading section where the tape cartridge is loaded, the tape cartridge comprising:

a tab portion which is provided on a surface of the tape cartridge that faces the open/close cover when loaded in the cartridge loading section, and which is configured to move between a gripping position and a non-gripping position in relation to the surface; and an energizing portion which energizes the tab portion toward the gripping position;

wherein when the tape cartridge is loaded in the cartridge loading section and the open/close cover is closed, the tab portion is pressed by a pressing portion provided on the open/close cover, and when the open/close cover is opened, the energizing portion causes the tab portion to be situated at the gripping position.

2. The tape cartridge according to claim 1, further comprising a recessed portion which is provided on a case wall situated on the front side and where the tab portion protrudes and sinks.

3. The tape cartridge according to claim 2, further comprising a print tape and a tape core on which the print tape is wound in such a way as to be able to be reeled off, wherein the recessed portion is arranged in such a way as to face an inner circumferential part of the tape core via the case wall.

4. The tape cartridge according to claim 3, wherein the tab portion is mounted in the recessed portion in such a way as to be able to rise and fall between the gripping position where the tab portion protrudes from the recessed portion and the non-gripping position where the tab portion sinks in the recessed portion.

5. The tape cartridge according to claim 3, wherein the tab portion is mounted in the recessed portion in such a way as to be able to advance and retreat between the gripping position where the tab portion protrudes from the recessed portion and the non-gripping position where the tab portion sinks in the recessed portion.

6. The tape cartridge according to claim 5, wherein the tape core is rotatably engaged with an outer circumferential surface of the recessed portion.

7. The tape cartridge according to claim 6, wherein the energizing portion has a compression coil spring formed by extending a part on the side of the tab portion in a radial direction, the tape core has a ratchet portion which the part on the side of the tab portion is engaged with and disengaged from, by expansion and contraction of the compression coil spring, and the part on the side of the tab portion is engaged with the ratchet portion in the state where the tab portion is moved to the gripping position, and is disengaged from the ratchet portion in the state where the tab portion is moved to the non-gripping position.

8. The tape cartridge according to claim 1, wherein the tab portion has a rough portion for slip proofing.

9. The tape cartridge according to claim 1, further comprising a lock mechanism which holds the tab portion at the non-gripping position.

10. A tape printing device comprising:

the cartridge loading section in which the tape cartridge according to claim 1 is loaded in an unloadable manner; and the open/close cover which opens/closes the cartridge loading section and has the pressing portion for pressing the loaded tape cartridge in a closed state.

* * * * *